United States Patent [19]

Vickers et al.

[11] 4,118,880

[45] Oct. 10, 1978

[54] MUZZLE REST

[76] Inventors: Charles K. Vickers; Patricia A. Vickers, both of 605 Clare Dr., Washington, Pa. 15301

[21] Appl. No.: 824,274

[22] Filed: Aug. 15, 1977

[51] Int. Cl.[2] ..... F41C 29/00
[52] U.S. Cl. ..... 42/94
[58] Field of Search ..... 42/94, 1 N, 76 R, 90

[56] References Cited

U.S. PATENT DOCUMENTS

| | | | |
|---|---|---|---|
| 613,241 | 11/1898 | Burton | 42/94 |
| 2,517,927 | 8/1950 | Reed | 42/94 |
| 2,607,147 | 8/1952 | Lampe | 42/1 N |
| 2,814,887 | 12/1957 | Hockley | 42/94 |
| 3,077,678 | 2/1963 | Royer, Sr. | 42/94 |

*Primary Examiner*—Charles T. Jordan
*Attorney, Agent, or Firm*—Buell, Blenko & Ziesenheim

[57] ABSTRACT

A muzzle rest for a gun barrel comprises a mounting plate affixed to the barrel carrying a foot projecting beyond the muzzle but offset therefrom.

4 Claims, 4 Drawing Figures

MUZZLE REST

This application relates primarily to guns used for trap and skeet shooting. It is more particularly concerned with means for supporting the muzzle of the gun above the ground when the gun is in rest position.

In competitive trap and skeet shooting the marksman between targets conventionally holds his gun with the barrel down. To lessen the weight of the gun which the gunner must support, it would be convenient to rest the muzzle on the ground, but that practice risks getting dirt in the barrel, or, if the gunner is standing on the concrete or the like, of nicking the muzzle. Consequently, various expedients have beem adopted by trap and skeet shooters to support the gun muzzle clear of the ground. Some gun clubs provide mats for this purpose. Where no such ground covering is furnished, some shooters use a rubber pad which, of course, must be moved every time the shooter changes his distance from the target. Other gunners rest the gun muzzle on a shoe tip, which quickly results in the formation of a black ring on the shoe from muzzle powder residue. Presently available on the market is a leather tongue-like device which fastens to a shoe lace and lies on top of the shoe. On this the gun muzzle may be rested.

It is an object of our invention to provide a device independent of the ground covering, if any, or of the marksman's footware, for supporting the muzzle of a gun above ground, when the gun is in the rest position. It is another object to provide such a device which can be attached to the gun barrel. Other objects of our invention will appear in the course of the description thereof which follows.

Our invention comprises, briefly, apparatus having a mounting plate which can be affixed to a gun barrel and which carries a foot projecting beyond the muzzle but offset therefrom. An embodiment of our invention presently preferred by us is illustrated in the attached Figures, to which reference is now made.

Figure 1:
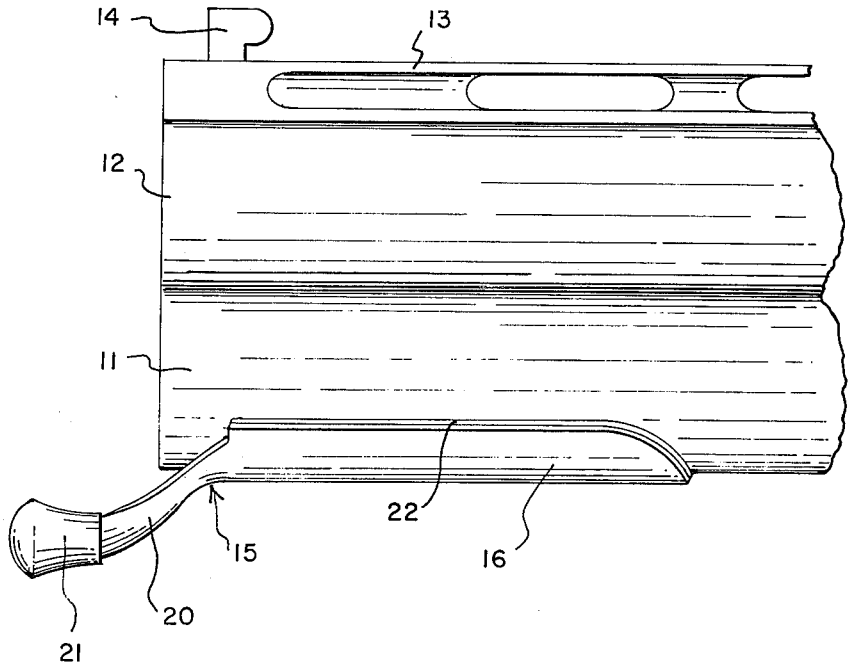
FIG. 1 is an elevation of a portion of a gun barrel having attached thereto the apparatus of our invention.
Figure 2:
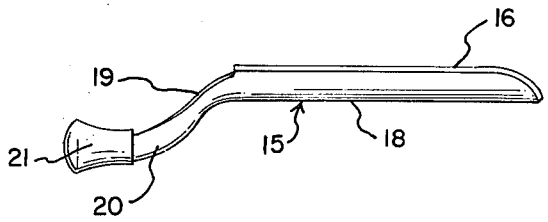
FIG. 2 is an elevation of the muzzle rest apparatus of FIG. 1.
Figure 3:
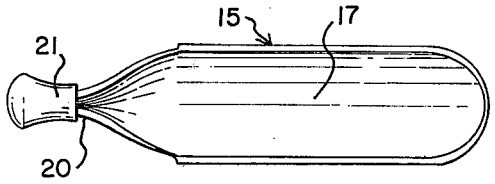
FIG. 3 is a plan of the underside of the muzzle rest of FIG. 2.
Figure 4:
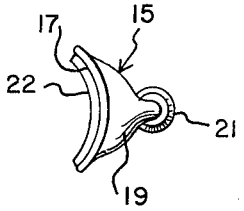
FIG. 4 is an end elevation of the apparatus of FIG. 3.

In FIG. 1 the under barrel 11 of an over-and-under shot gun is affixed to the over barrel 12 which on its upper surface carries the conventional rib 13 and front sight 14. Affixed to the underside of under barrel 11 is our muzzle rest 15, which is shown in more detail in FIGS. 2, 3 and 4.

Muzzle rest 15 comprises an elongated mounting plate 16 having a concave upper surface 17 and a convex lower surface 18. Plate 16 is curved transversely to match the outer surface of barrel 11. One end of plate 16 is prolonged as a tongue 19 inclined away from plate 16 on the side of convex surface 18 and terminating in a foot portion 20 which is parallel to plate 16, but offset therefrom, and which is provided with a bumper 21 of rubber or rubber-like material.

The concave surface 17 of plate 16 is provided with a layer of pressure-sensitive adhesive 22. Muzzle rest 15 is affixed to a gun barrel 11 by pressing it against barrel 11 so that the pressure-sensitive adhesive 22 is forced against the exterior surface of the gun barrel.

Foot portion 20 need extend only a short distance beyond the muzzle of barrel 11, an inch or less, and need be offset only enough to be out of the path of shot, a distance of half-an-inch or so. Our muzzle rest is permanently attached to the gun barrel so that it is always ready for use, but does not interfere in any way with the normal use of the gun.

In the foregoing specification we have described presently preferred embodiments of our invention; however, it will be understood that our invention can be otherwise embodied within the scope of the following claims.

We claim:

1. A muzzle rest adapted to be attached to a gun barrel so as to support the muzzle above ground when the gun is positioned vertically with barrel down, comprising an elongated mounting plate curved transversely so as to conform to the gun barrel, a foot projecting therefrom at one end, and offset therefrom, and means affixed to the concave surface of the mounting plate for attaching the mounting plate to a gun barrel.

2. The muzzle rest of claim 1 in which the means for attaching the mounting plate to a gun barrel comprise a layer of pressure-sensitive adhesive.

3. In combination, a gun barrel and a muzzle rest therefore, comprising a foot having an elongated mounting plate curved transversely so as to conform to the gun barrel and extending axially therefrom beyond the muzzle of the barrel and offset thereform.

4. The combination of claim 3 in which the muzzle rest is permanently affixed to the gun barrel.

* * * * *